United States Patent [19]

Lackey et al.

[11] Patent Number: 4,574,709

[45] Date of Patent: Mar. 11, 1986

[54] SHELF ELEMENT AND SUPPORT THEREFOR

[75] Inventors: Robert W. Lackey, Hickory, S.C.; James L. Gebhardt, Roswell, Ga.

[73] Assignee: The Mead Corporation, Dayton, Ohio

[21] Appl. No.: 557,925

[22] Filed: Dec. 5, 1983

[51] Int. Cl.[4] ..... A47B 3/00; A47F 43/00

[52] U.S. Cl. ..... 108/111; 108/156; 108/150; 211/186; 211/153

[58] Field of Search ..... 211/188, 194, 133, 186, 211/153; 108/111, 150, 151, 153, 159, 156, 91, 53.1, 53.5; 206/821, 503, 509, 511; 220/84

[56] References Cited

U.S. PATENT DOCUMENTS 3,858,529 1/1975 Salladay ..... 108/111

4,467,927 8/1984 Nathan ..... 108/111

*Primary Examiner*—William E. Lyddane

*Assistant Examiner*—Gerald A. Anderson

*Attorney, Agent, or Firm*—Rodgers & Rodgers

[57] ABSTRACT

To provide support for a plurality of shelf elements disposed one above another, each shelf element is provided with one or more apertures for receiving tubular shelf supporting posts and each aperture is arranged to be closed by means including a support sleeve projecting from a lower surface of each shelf element together with support means mounted on the inner surface of said support sleeve for supporting and positioning suitable closure means disposed within each shelf aperture and mounted on said support means so as to provide a partial closure therefor but which is adapted to receive the lower end of a support post for another higher shelf. Each shelf element affords a multiplicity of arrangements for receiving mounting posts so that the unused shelf apertures are partially closed so as not to derrogate from the function of the shelf as a supporting device for various items to be supported or displayed.

14 Claims, 7 Drawing Figures

SHELF ELEMENT AND SUPPORT THEREFOR

TECHNICAL FIELD

This invention relates to shelf structures for use in forming displays used in merchandising a wide variety of items.

BACKGROUND ART

U.S. Pat. No. 4,314,648 issued Feb. 9, 1982 and assigned to the assignee of this invention discloses a plurality of display shelves forming a part of a display stand wherein the shelves are supported by a back structure.

U.S. Pat. No. 4,379,431 issued Apr. 12, 1983 and owned by the assignee of this invention discloses a shelving assembly in which a plurality of shelves are supported by corner posts.

Neither of the above patents is adapted to afford a variety of shelf supporting means.

DISCLOSURE OF THE INVENTION

According to this invention in one form, a planar shelf element is modified so as to adapt such shelf element to be supported by one or more tubular posts whose cooperation with the shelf structure may be chosen among a multiplicity of possible locations thereby to adapt the shelf and its support for use under a wide variety of circumstances and for a number of different products having different weights and physical dimensions.

More specifically a shelf planar element is provided with a support structure which includes at least one aperture formed in the planar element, a support sleeve projecting downwardly from the planar shelf element and having one end in substantial coincidence with the shelf aperture, support means mounted on the inner surface of said support sleeve, for engaging an end of a support post telescopically mounted within said support sleeve together with closure means disposed within the aperture formed in the shelf element and mounted on the support means so as partially to close the shelf aperture without interferring with the mounting of another support post within said aperture to support another shelf disposed at a higher level.

BEST MODE OF CARRYING OUT THE INVENTION

Figure 1:
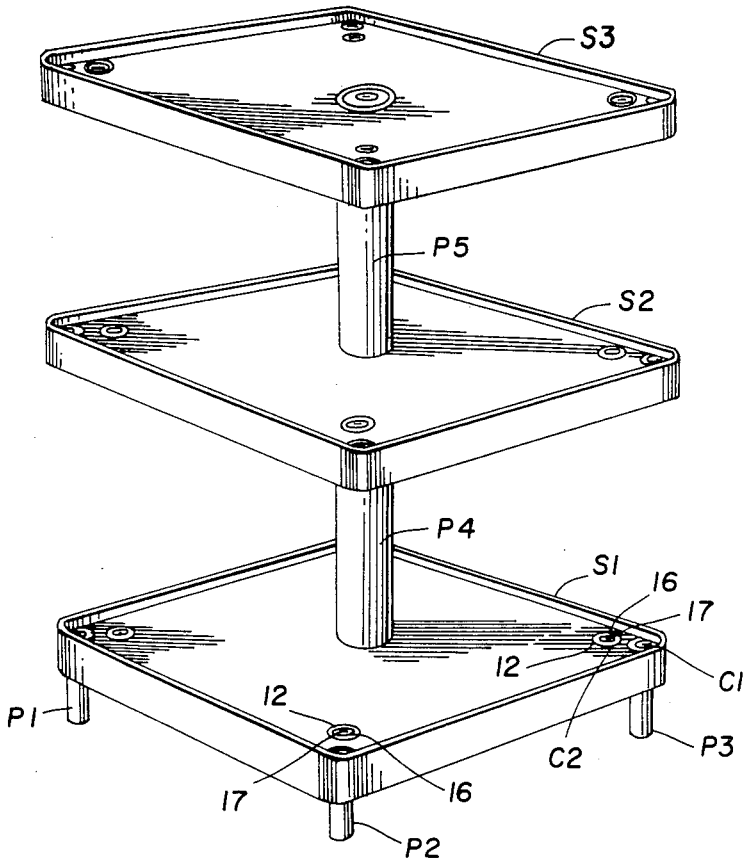
FIG. 1 is a perspective view of a display formed of a plurality of shelves constructed according to this invention and wherein the upper two shelves are supported by a single center post and wherein the lowermost shelf is supported by corner posts.
Figure 2:
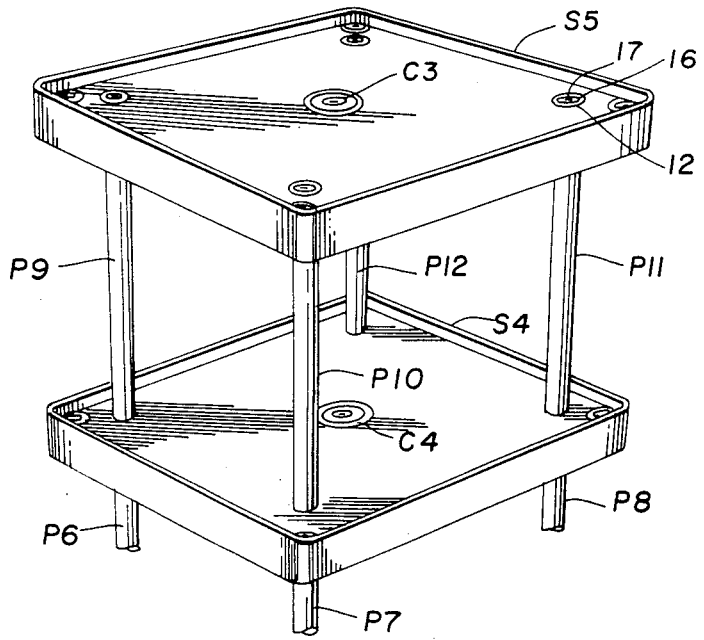
FIG. 2 is a view of a display device in which the shelf elements are formed according to this invention and wherein the upper shelf is supported by corner posts rather than by a single center post.

The shelf units shown in FIGS. 1, 2, 3 and 4 are identical in structure and are identified at S. Support structure for shelf S1 in FIG. 1 is at the corners of the shelf whereas the support structure for shelves S2 and S3 in FIG. 1 are by means of individual center posts. In FIG. 2 the support structure for shelf S4 is similar to that for shelf S1 except that the corner posts are moved inwardly somewhat. The support for shelf S5 is similar to that for shelf S4.

Shelf S1 is supported by corner posts P1, P2, P3 and by a fourth corner post not shown in FIG. 1. Shelf S2 on the other hand is supported by a center post P4 while shelf S3 is similarly supported by a center post P5.

In FIG. 2 shelf S4 is supported by posts P6, P7, P8 and by a fourth post not shown in FIG. 2. These posts as is obvious are inset somewhat from the corner locations of posts P1, P2 and P3. In like fashion shelf S5 is supported by inset posts P9, P10, P11 and P12.

Since all of the shelves are of identical construction, in accordance with one feature of this invention, unused shelf apertures are partially closed by suitable closure means. In FIG. 1 these closure structures are generally indicated for example at C1 and C2 and in FIG. 2 the large center apertures are partially closed by closure elements such as are indicated at C3 and C4.

Figure 3:
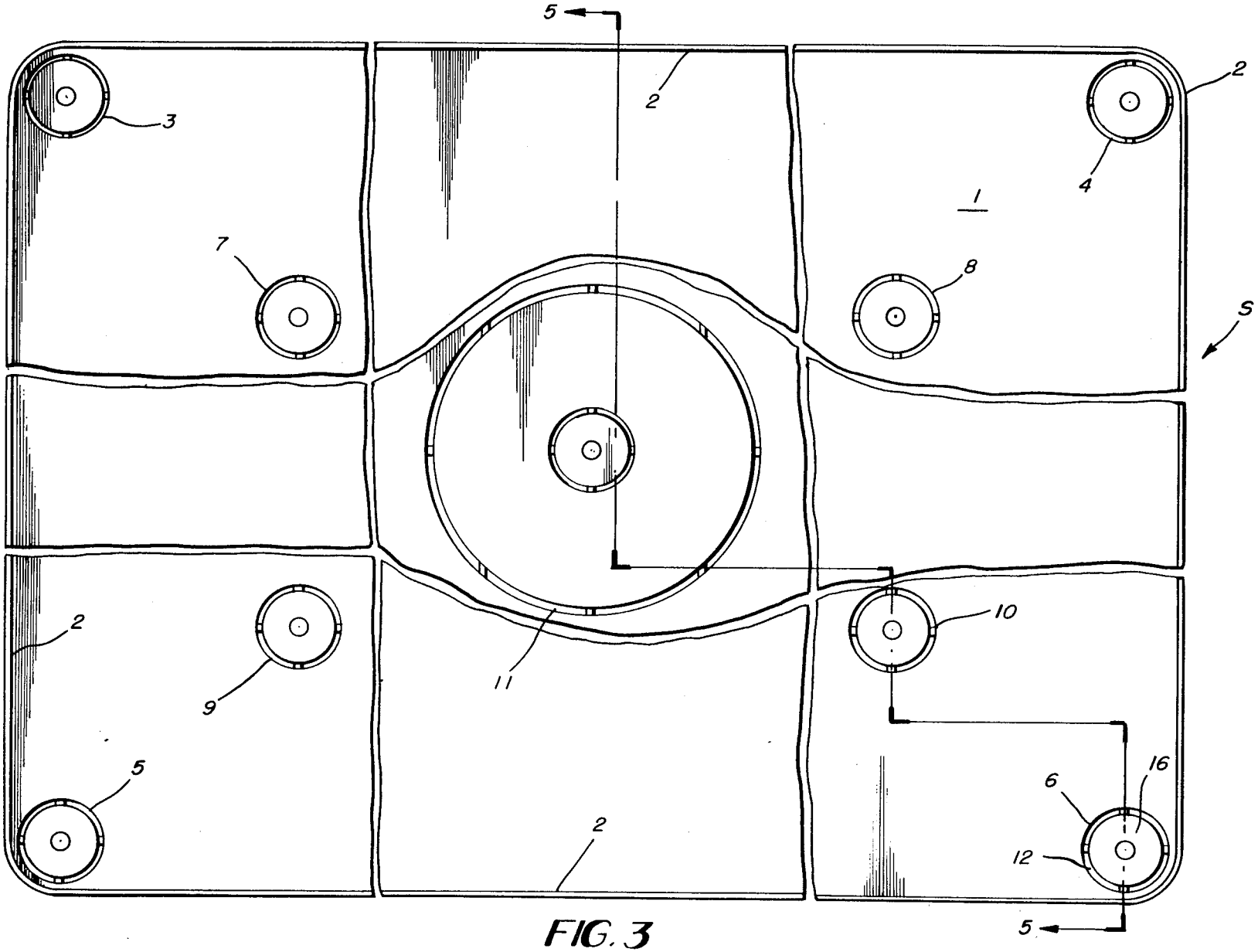
FIG. 3 is a plan view from above of a planar shelf element used in forming the arrangements of FIGS. 1 and 2.

As is shown in FIG. 3, the shelf S includes a flat planar shelf element 1 bounded by a peripheral skirt 2. Corner support structures and their associated closure elements are shown in FIG. 3 and designated by the numerals 3, 4, 5 and 6 while inset support structure and associated closure elements are shown in FIG. 3 and designated by the numerals 7, 8, 9 and 10 and center support structure and associated closure elements are designated by the numeral 11. As is obvious portions of FIG. 3 and FIG. 4 are broken away.

Figure 4:
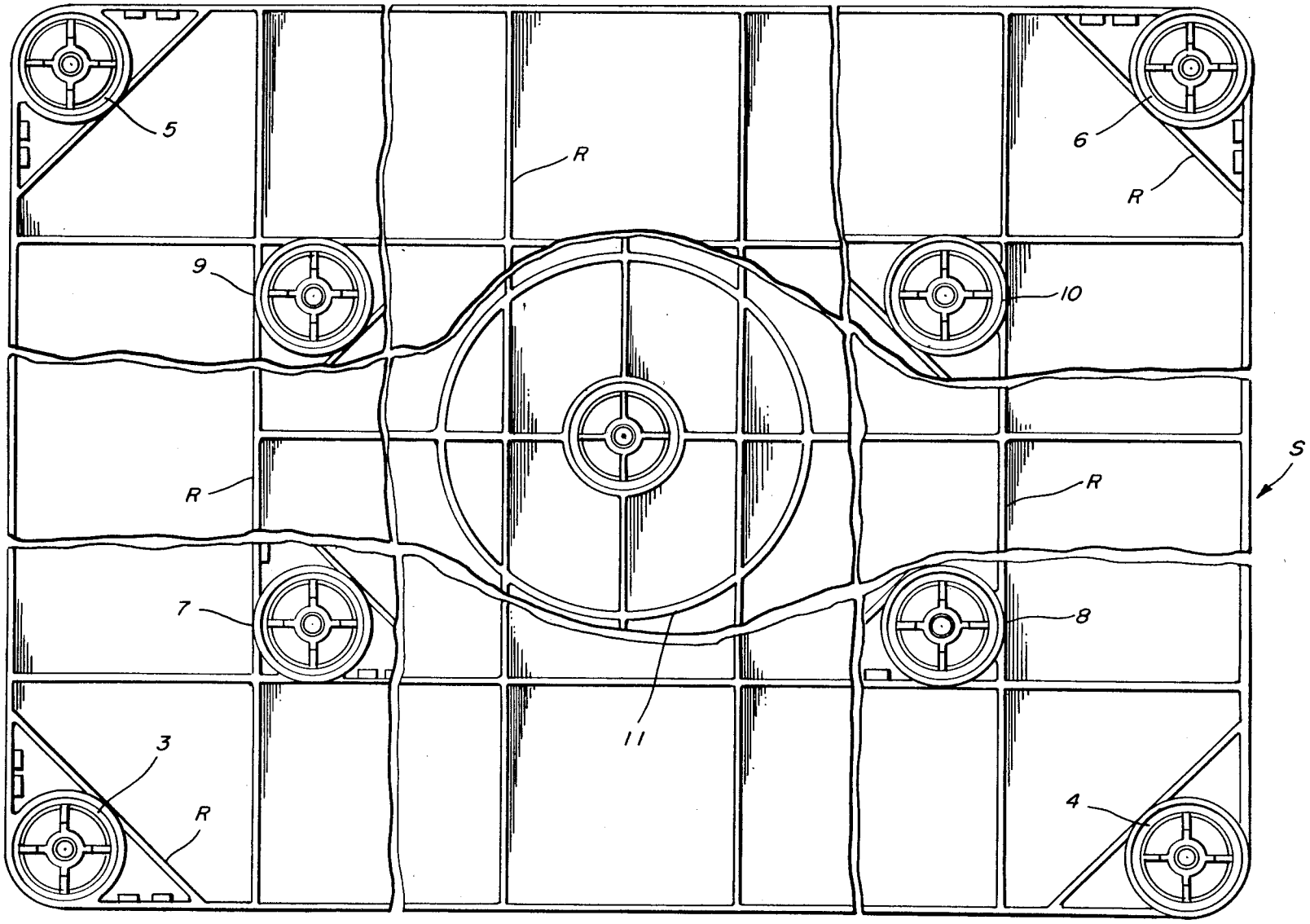
FIG. 4 is a plan view from below of the structure shown in FIG. 3.

As is shown in FIG. 4, reinforcing ribs extend both transversely and longitudinally and are designated at R in random fashion since these ribs simply add mechanical strength and do not really constitute essential features of the novel aspects of this invention although the reinforcing ribs of course are vital in that they add substantial mechanical strength to the structure.

Figure 5:
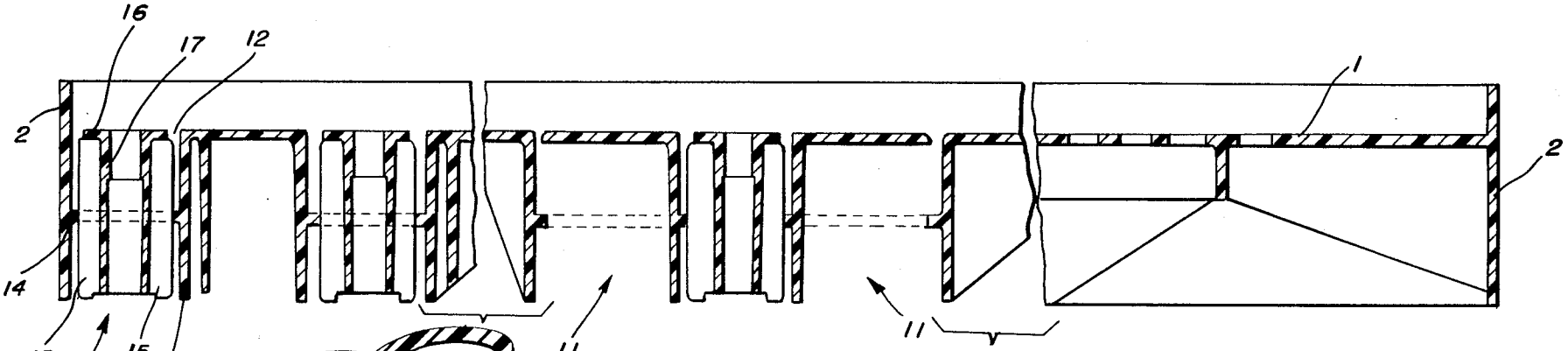
FIG. 5 is a cross sectional view taken along the line designated 5—5 in FIG. 3.
Figure 6:
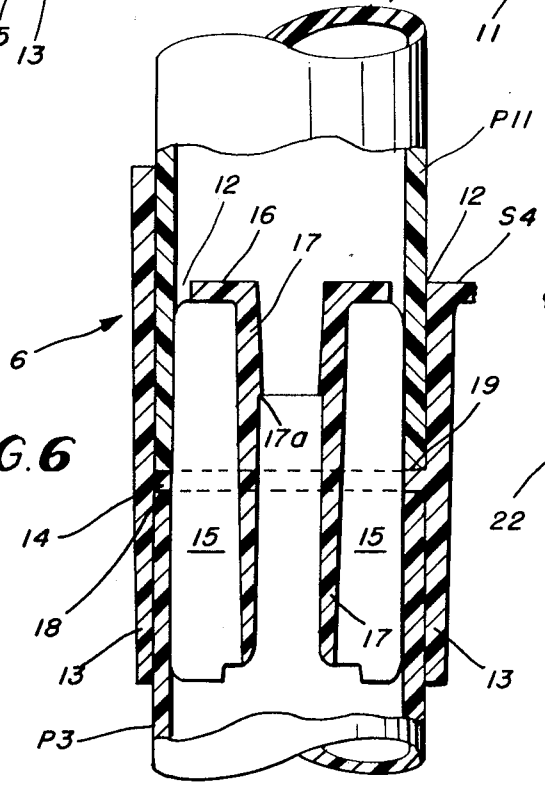

Since the support structures 3–10 are identical, only one such structure such as 6 is here described in detail. With reference to FIGS. 5 and 6 support structure 6 includes an aperture 12 formed in planar element 1. A support sleeve 13 is arranged with its upper end in coincidence with aperture 12 and extends downwardly therefrom. The peripheral skirt 2 forms an upward extension of a part of sleeve 13. Support means includes an inner flange 14 disposed about the inner surface of sleeve 13 together with a plurality of radially disposed support elements 15 which are integrally formed with flange 14. Closure means for aperture 12 includes closure part 16 which is grommet shaped together with a downwardly extending tubular element 17 having an outer flange 16 which is integrally formed with tubular element 17. Closure elements 16 and 17 are mounted on and integrally formed with the radial support elements 15. As is obvious from FIG. 3 closure element 16 effectively closes the aperture 12 and affords an effective support for items displayed on the shelf.

As is best shown in FIG. 6 tubular post P3 is inserted within the sleeve 13 from below and is arranged with its upper end 18 in abutting engagement with the flange 14 thereby to afford support for the shelf such as S1.

In order to afford support for a shelf such as S5, a post such as P11 is inserted downwardly through aperture 12 so that its lower end 19 comes into abutting engagement with the flange 14 as shown in FIG. 6. In like fashion all of the posts which support shelf S5 such as P9, P10, and P12 are interrelated with a shelf such as S4 in a manner described in connection with post P11 and the support for a shelf such as S4 is provided by posts P6, P7, P8 and a post not observable in the drawing is identical to that shown and described in connection with post P3 except that posts which support S4 cooperate with inset apertures rather than corner apertures such as C1 in shelf S1.

The structure for P4 and P5 is identical to that just described in that the upper end 20 of post P4 engages the lower surface of flange 21 formed on the inner surface of support sleeve 22 and the lower surface 23 of post P5 engages the upper surface of flange 21.

Figure 7:
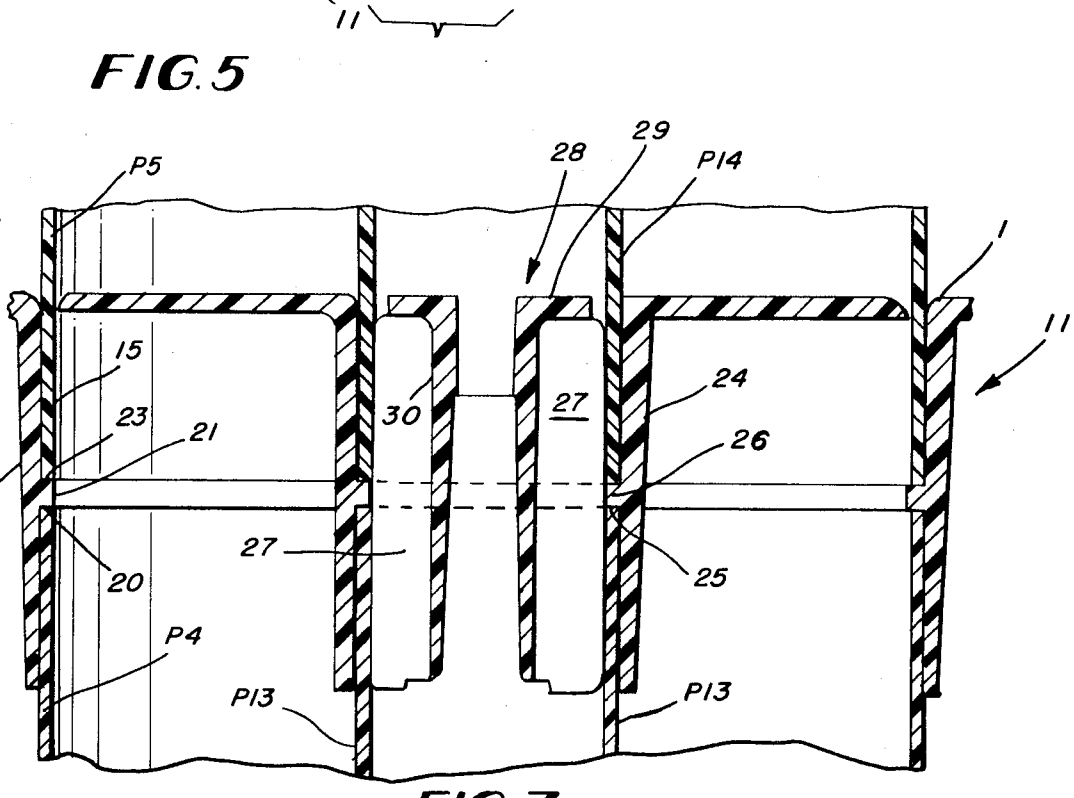
FIGS. 6 and 7 are enlarged cross sectional views of portions of FIG. 5.

For some applications of the invention it may be desirable to eliminate the large center post such as P4 and P5 and to use instead a smaller post such as P1, P2, or P3 mounted at the center of shelves such as S2 and S3 in which event the larger post would not be used and a smaller post such as is indicated in FIG. 7 at P13 would be employed and would simply be telescopically mounted inside the downwardly extending support sleeve 24 with its upper end 25 in engagement with the lower surface of flange 26. Where the small center post is used it may be desirable to use corner or inset posts as well. Radially extending elements 27 are arranged so as to support closure element 28 having tubular element 30 and its outer flange 29. Thus closure 28 effectively closes the central aperture which may serve to receive small center post P14 if desired.

For some applications of the invention it is desirable to mount the lower shelf on castors rather than on posts. If such be the case in a particular instance and in accordance with one feature of the invention, the stem of suitable conventional castors not shown may simply be inserted into the tubular structures 17 so that the upper end portion thereof abuts the shoulder 17*a* and by this means suitable mobility may be provided for the display as may be desired.

INDUSTRIAL APPLICABILITY

According to this invention, improved support structure for a planar shelf element is provided which is economical to manufacture as well as to maintain and assemble and which affords a variety of post locations so as to accommodate different circumstances and products to be displayed and the posts employed may be circular in cross section or may be of any other suitable configuration as may be desired.

We claim:

1. Support structure for a planar shelf element having an upper and a lower surface and comprising an aperture formed in said planar element, a support sleeve projecting downwardly from said lower surface of said planar element and having an inner surface at the upper end thereof disposed in substantial coincidence with said aperture, support means mounted on the inner surface of said support sleeve, closure means including a tubular element having an outer flange in the plane of said planar shelf element and disposed within said aperture and mounted on said support means for closing at least a substantial part of said aperture, to provide a substantially continuous upper surface, and mounting post means selectively received by said support structure so that when said mounting post means is not arranged to project upwardly from said shelf element a substantially continuous shelf upper surface is provided.

2. Support structure according to claim 1 wherein said aperture and the inner surface of said sleeve are of substantially the same configuration.

3. Support structure according to claim 1 wherein said planar shelf element and said sleeve are integrally formed.

4. Support structure according to claim 1 wherein said support means comprises an inner flange on said sleeve.

5. Support structure according to claim 4 wherein said support means comprises a plurality of radial support elements supported by said inner flange and integral with at least a part of said closure means to provide support therefor.

6. Support structure according to claim 1 wherein said flange is smaller than but of similar configuration to said aperture so as to define a clearance passage about said flange and within said aperture.

7. Support structure according to claim 5 wherein said tubular element is integral with and interposed between said radial support elements.

8. Support structure according to claim 1 wherein a first tubular support post is telescopically mounted within said support sleeve and having an end thereof in engagement with a part of said support means.

9. Support structure according to claim 8 wherein said tubular post is mounted within said support sleeve by means of a pressed fit.

10. Support structure according to claim 5 wherein said radial support elements are integral with said tubular element.

11. Support structure according to claim 8 wherein a second tubular support post is telescopically mounted within said support sleeve and disposed about said outer flange and having an end thereof in engagement with the part of said support means which is opposite from the part with which said first support post is in engagement to afford support for another shelf element disposed above said planar shelf element.

12. Support structure according to claim 8 wherein said tubular post constitutes a receptacle for receiving a part of a removable castor.

13. Support structure according to claim 1 which is formed by an injection molding procedure.

14. Support structure according to claim 1 wherein an integral peripheral skirt is disposed about said planar shelf element.

* * * * *